US005100052A

United States Patent [19]

Vajtay

[11] Patent Number: 5,100,052

[45] Date of Patent: Mar. 31, 1992

[54] TUBULAR DISPLAY PACKAGES WITH TAB LOCKING, DOUBLE WALL HOLLOW INSERT CLOSURE BOX

[75] Inventor: Laszlo Vajtay, Rahway, N.J.

[73] Assignee: SLM Manufacturing Corporation, Somerset, N.J.

[21] Appl. No.: 760,279

[22] Filed: Sep. 16, 1991

[51] Int. Cl.[5] ..... B65D 25/54

[52] U.S. Cl. ..... 229/162; 229/23 R; 229/125.17; 229/125.28; 206/45.31

[58] Field of Search ..... 229/125.17, 125.28, 229/125.32, 23 R, 162; 220/401; 206/45.31, 45.33, 45.34

[56] References Cited

U.S. PATENT DOCUMENTS

| | | | |
|---|---|---|---|
| 2,111,838 | 3/1938 | Brown | 229/125.17 |
| 3,342,401 | 9/1967 | Kitchell | 229/125.28 |
| 3,447,672 | 6/1969 | Bailey et al. | 229/125.28 |
| 3,632,038 | 1/1972 | Souza | 229/125.19 |
| 3,899,117 | 8/1975 | Peyser et al. | 229/125.17 |
| 3,913,774 | 10/1975 | Vajtay | 220/401 |
| 3,986,659 | 10/1976 | Vajtay | 229/175.17 |
| 4,291,829 | 9/1981 | Vanderlugt, Jr. | 229/125.17 |
| 8,933,297 | 1/1976 | Carlsson et al. | 229/125.17 |

*Primary Examiner*—Stephen Marcus
*Assistant Examiner*—Christopher McDonald
*Attorney, Agent, or Firm*—Sughrue, Mion, Zinn, Macpeak and Seas

[57] ABSTRACT

Longitudinal extensions of the outer panel of a double-walled insert closure box form tabs to opposite sides of an open-ended tubular sleeve of a rectangular cross-section having opposed longitudinal spaced end walls within which rectangular, parallelepiped, hollow insert closure boxes are inserted. Narrow elongated slots within the sleeve end walls and the box end walls extending parallel to the outer panel, insertably receive an integral lug at the terminal end of the tabs. The lugs have laterally opposed projections forming a barb of a width in excess of the length of the elongated slots to frictionally lock the insert closure box to the tubular sleeve when the extensions are bent at right angles to the outer panel and the lugs bent at right angles thereto and passed through the aligned slots. Insert closure boxes at respective ends of the tubular sleeve, are preferably formed of folded cardboard sheet material precut as a single box blank from a sheet of cardboard. The open-ended tubular sleeve may be formed transparent flexible plastic sheet material.

12 Claims, 2 Drawing Sheets

FIG. 1
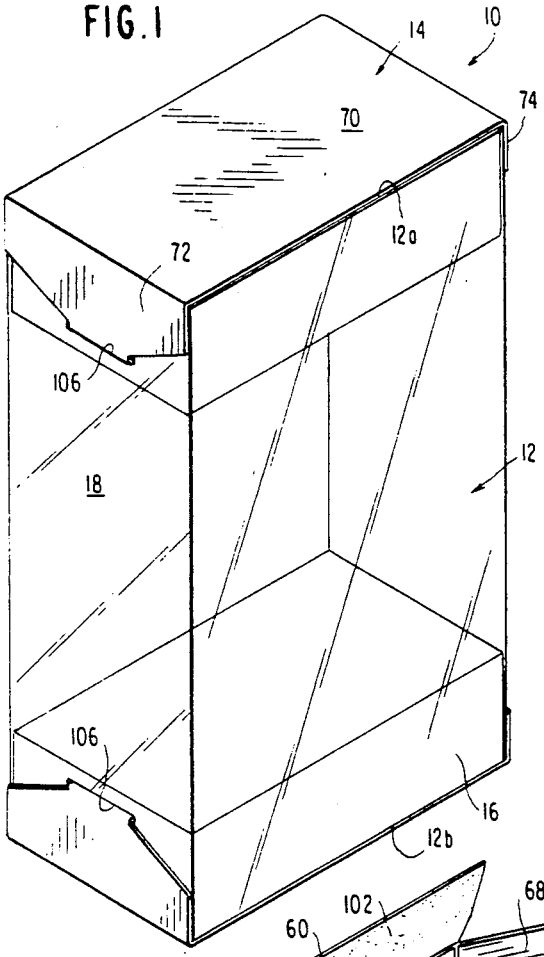
FIG. 2
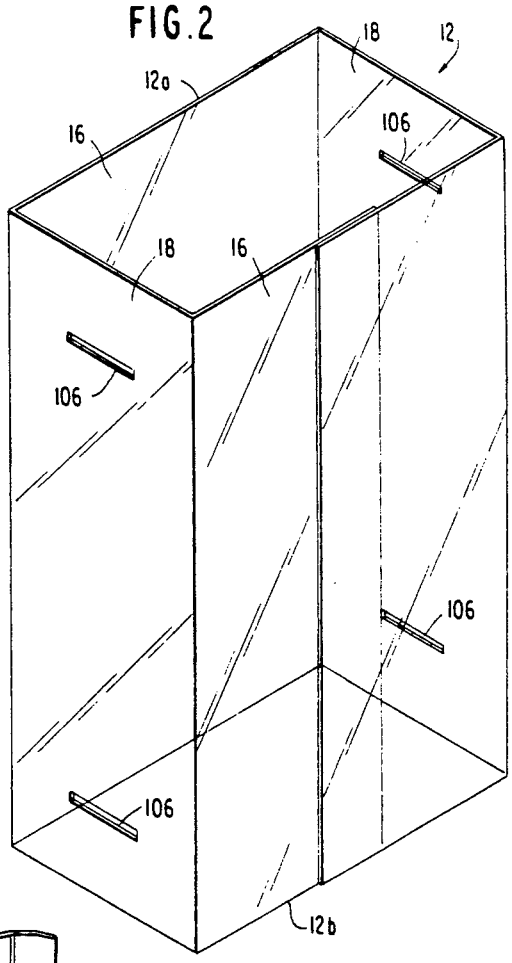
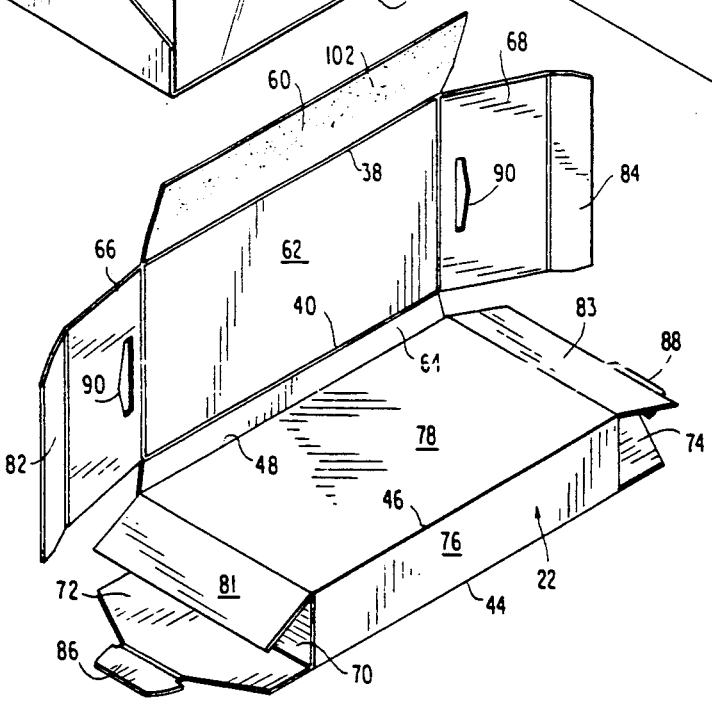
FIG. 4

TUBULAR DISPLAY PACKAGES WITH TAB LOCKING, DOUBLE WALL HOLLOW INSERT CLOSURE BOX

FIELD OF THE INVENTION

This invention relates to the forming of tubular containers or packages by axially inserting locking closures within opposite ends of a clear plastic rectangular form tubular sleeve, and more particularly to such containers or packages in which the locking closures are formed of hollow cardboard, parallelepiped boxes with locking tabs integrated to, and forming extensions of the outer panel closing off the end of the clear plastic tubular sleeve.

BACKGROUND OF THE INVENTION

The corporation assignee of this application has produced tubular packages or containers over the last 15 years as exemplified by U.S. Pat. No. 3,986,659, issued Oct. 19, 1976 entitled "END CAPS FOR TUBULAR CONTAINERS; " U.S. Pat. No. 3,913,774, issued Oct. 21, 1975 entitled "END CAPS FOR CONTAINERS"; and U.S. Pat. No. 4,700,883, issued Oct. 20, 1987 and entitled "TUBULAR PACKAGE AND END CAP FORMING COMPONENT OF SAME" wherein, a hollow, rectangular, clear plastic tubular sleeve, is normally formed of a thermoplastic material, approximately 0.005–0.02 inches in thickness, and held to a preformed polygon shape by rigid end caps locked thereto.

The patents identified above exemplify the use of tabs projecting outwardly from edges of rigid end caps formed of the same thermoplastic sheet material which forms the flexible tubular sleeve, which tabs are insertable within elongated slots formed within the opposed walls of the tubular sleeve at the ends receiving the rigid end caps.

Such arrangements obviated the prior use of adhesive, tape, staples and other fasteners which were unsightly or enlarged the tubular sleeve, the end caps or both.

In the development of such display packages or containers, supports for the articles packaged within the transparent plastic sleeve have been created from folded cardboard or other flexible sheet material, functioning additionally as, end caps or inserts within the open opposite ends of the tubular sleeve.

U.S. Pat. No. 3,608,705 issued Sept. 28, 1971 exemplifies such display package including a support of cardboard flexible sheet material. In U.S. Pat. No. 3,608,705, the support is made up of two parts of folded cardboard. A rectangular article support base locks to a hollow cardboard parallelepiped tube insert by way of slits formed within each hollow insert wall closing off the open end of the tubular sleeve and arrow headed tabs project as extensions from opposite ends of the support base panel aligned with the slots and projecting therethrough.

Such tab and slot connection had been employed additionally in locking a base to a cover in U.S. Pat. No. 4,782,977 issued Nov. 8, 1988 and entitled Tamper Resistant Container; locking a lid to a preformed container both formed of cardboard flexible sheet material. In U.S. Pat. No. 4,923,113 issued May 8, 1990 and entitled "CONTAINER WITH A PERFECTED LID"; coupling of molded plastic rigid end caps into opposite ends of a polygonal cross-section clear plastic shell body is effected by holes within the wall of the shell body at opposite ends aligned, and the end cap, via pin-like integrally molded lugs which extend inwardly from flexible flaps molded integrally with the edge of the end cap wall closing off the open end of the shell body and being a length so as to extend along the outer surface of the shell body wall.

In the production of such tubular packages, due to the thinness of the extruded or nonextruded clear plastic material forming the basic stock material for the sides of the tubular sleeve, the end caps or closures for the sleeve must be relatively rigid and have sufficient structural strength to maintain the integrity of the container or package once completed and to support the article packaged within the tubular sleeve as well as prevent inadvertent separation of the end caps from the tubular sleeve.

It is therefore the primary object of the present invention to provide an improved, low cost, reinforced folded cardboard end closure for a tubular container which self locks to the transparent tubular sleeve, which resists separation of the end closure from the sleeve, which may be formed of a single cardboard precut blank, which provides an attractive addition to the transparent sleeve, and which completes a highly stable, rigid connection therebetween.

SUMMARY OF THE INVENTION

The invention is directed to an improved stable, rigid display package comprising an open-ended flexible plastic sheet material tubular sleeve of rectangular cross-section including laterally opposed side walls and longitudinally opposed end walls. At least one folded sheet material parallelepiped hollow outer insert closure box including opposed inner and outer panels, laterally opposed side walls and longitudinally opposed end walls sized to the internal dimensions of said sleeve, is fitted into an open end of said sleeve. Aligned elongated, narrow slots are provided within opposite end walls of both said sleeve and said outer insert closure box. The outer panel of the outer insert closure box includes integral tabs at opposite ends thereof, extending beyond the longitudinally opposed end walls of said tubular sleeve of a width corresponding to that of said closure box outer wall. The tabs are folded, at right angles, over and parallel to said sleeve end walls, and extending along the exterior surface of said sleeve end walls. The tabs terminate, at the end remote from said outer insert closure box outer wall in a lug of a width generally equal to the length of said aligned slot, said tab projecting at right angles to the portion of said extension along the exterior of said tubular sleeve end wall and the lug projecting through said aligned slots to frictionally lock said outer insert closure box to the open end of the tubular sleeve insertably receiving the same.

Preferably, the elongated slots within the outer insert closure box end walls are of a slightly shorter length than the slots within the tubular sleeve and are equal to the lateral width of said tab. The tabs terminating at their ends remote from the closure box outer wall in lugs, have lugs of quadrilateral-trapezium shape joined to the base of the tabs by a narrow band s defining projections at opposite edges of the lugs of a width which is slightly in excess of the length of the slots through which the lugs pass to securely and rigidly lock the outer insert closure box in its inserted position within the open end of the tubular sleeve to the sleeve.

Alternatively, the locking lugs may be of arrow head configuration and triangle plan form.

Preferably, the hollow insert closure box is of a double wall form including an inner box section of rectangular, parallelepiped form with laterally spaced side walls slightly shorter than those of an outer box section tightly fitted to the inner box section and forming a cavity or space between the inner panels of the inner and outer box section, respectively. As such, the aligned narrow, elongated slots which receive the locking lugs within the tubular sleeve end walls and the outer closure box section end walls, open to the cavity whereby, the inner box section reinforces the outer box section without interfering with the engagement of the locking lugs and slots in locking the closure box to the tubular sleeve at an end thereof. Preferably, the double wall closure box is formed of a pre-cut, folded and adhesively joined, unitary box blank.

BRIEF DESCRIPTION OF THE DRAWINGS

FIG. 1 is a perspective view of an improved tubular display package with double wall tab locking insert closure boxes, forming a preferred embodiment of the invention.

FIG. 2 is a perspective view of the tubular sleeve forming one element of the display package of FIG. 1.

FIG. 4 is a perspective view of one of the insert closure boxes of the display package of FIG. 1 with the inner box section partially folded for adhesive attachment of the inner and outer box section side walls.

DESCRIPTION OF THE PREFERRED EMBODIMENT

Figure 3:
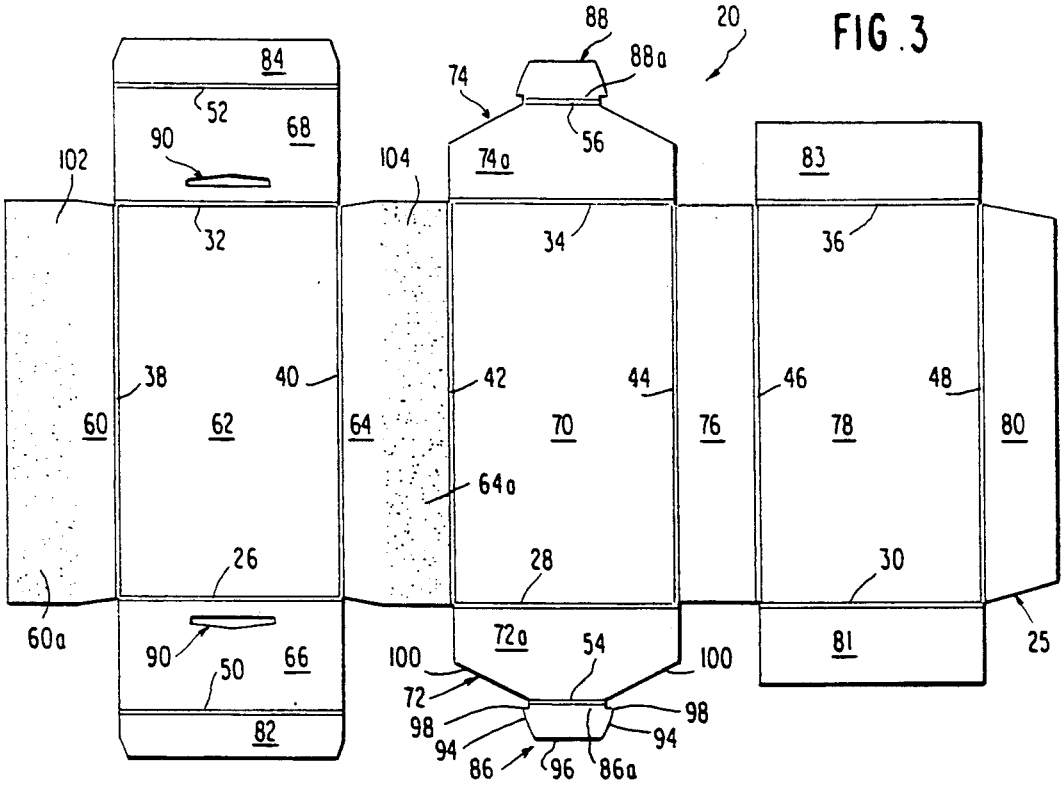
FIG. 3 is a plan view of the double wall insert box closure blank, after cutting and prior to folding of same.

Referring to the drawings, and initially FIG. 1, that figure shows a tubular display package indicated generally at 10, comprising an open-ended flexible transparent plastic sheet material sleeve 12 having inserted into opposite, open ends 12*a* and 12*b* and frictionally coupled thereto, hollow, rectangular parallelepiped, double wall, tab locking closure boxes indicated generally at 14. The insert closure boxes 14 are preferably formed of folded sheet material such as thin cardboard and preferably structurally reinforced by having formed from a blank of cardboard sheet material an outer box section 24, and an inner box section 22 completely interior of the outer box section 24. Each insert box closure box 14 is preferably constituted by a one piece blank cut from the cardboard or other similar flexible sheet material, as illustrated in FIG. 3.

The transparent sleeve 12 is preferably formed of a shape-retaining clear plastic sheet material which is, in the illustrated embodiment, of rectangular cross-section, although the configuration may be of various polygonal forms, such as a square. In the illustrated embodiment, the tubular sleeve 12 is vertically upright, that is, its axis is vertical and has laterally opposed longitudinally extending side walls 16 and longitudinally opposed end walls 18.

A one-piece blank indicated generally at 20, FIG. 3, is severed from a cardboard stock sheet material along an exterior severing line 25, is generally of elongated, modified, rectangular form and, when folded and adhesively secured to itself over portions thereof, forms a double-walled structure constituting principally of inner box section 22, and outer box section 24. Prior to folding, the blank may be lightly scored to create the fold lines facilitating the folding of segments of the blank into a desired form. Lightly scored fold lines are provided in line with each other running vertically, FIG. 3, at 26, 28 and 30 on the left side of the blank, and corresponding lightly scored fold lines at 32, 34 and 36, running vertically on the right side. These lines are interspersed by the peripheral severance line 25, which runs the complete exterior of the cut blank 20. Lightly scored horizontal fold lines are in descending order, FIG. 3, at 38, 40, 42, 44, 46 and 48. Additional lightly scored fold lines are provided at 50 and 52 to the left and right of fold lines 26 and 32, respectively, and parallel thereto. Lightly scored fold lines 54 and 56 are provided to the left and right of vertical scored lines 28 and 34 at the middle of the cut blank 20. As a result, the fold lines define within blank 20, for outer box section 24; an outer box section side wall at 60, an inner panel 62 for the outer box section 24, outer box section side wall 64 and an outer panel 70 for that outer box section 24. Additionally, to opposites sides of the outer box section inner panel 62, there is formed an outer box section end wall 66, to the left, and one at 68 to the right. Further, fold lines 50 and 52 define for respective outer box section end walls 66 and 68, outer box section end wall flaps 82 and 84.

For inner box section 22, fold lines 44 and 46 define along with the peripheral severance line 25, an inner box section side wall 76, and fold lines 44 and 48 define, with vertical fold lines 30, 36, an inner panel 78. Scored, fold line 48 defines an inner box side wall 80. The vertical fold lines 30, 36 form, with the peripheral severance line 25, left and right, inner box section end walls of rectangular configuration, at 81 and 83, respectively.

With the exception of the outer box section outer panel 70 locking tabs 72 and 74, formed respectively by fold lines 28 and 34 and the peripheral severance line 25, the outer box section end walls 66 and 68 and the inner box section end walls 82 and 84 are generally of rectangular form. However, for the outer panel extensions or locking tabs 72, 74, those tabs include an initial base portion proximate to the outer panel 70 as at 72*a*, 74*a* which are equal in width to that of the outer box section outer panel 70, from which they extend. Tabs 72, 74, in plan form, are of six-sided polygon configuration including vertical fold lines 54, 56 which are significantly shorter than parallel fold lines 28, 34 at their connections to the outer panel 70. Extending laterally outwardly from fold lines 54 and 56 are, vertically centered, integral locking lugs, indicated generally at 86 and 88, respectively.

The locking lugs 86, 88 have a shape of a quadrilateral-trapezium joined to tab base portions 72*a*, 74*a*, respectively, by narrow bands which are of a lateral width equal to the length of a narrow elongated slots 90 within the outer box section end walls 66, 68. Lugs 86 20 and 88 are respectively inserted within slots 90 when locking the insert closure box 14 to the respective ends 12*a*, 12*b* of the tubular sleeve 12. To effect that action, the plan configuration given to the locking lugs 86 and to form narrow bands 86*a*, 88*a* has opposed side edges 94 of the lug 86 as oblique in a direction towards each other, away from fold line 54, and towards a flat vertical line 96 joining the oblique side edges 94.

Figure 5:
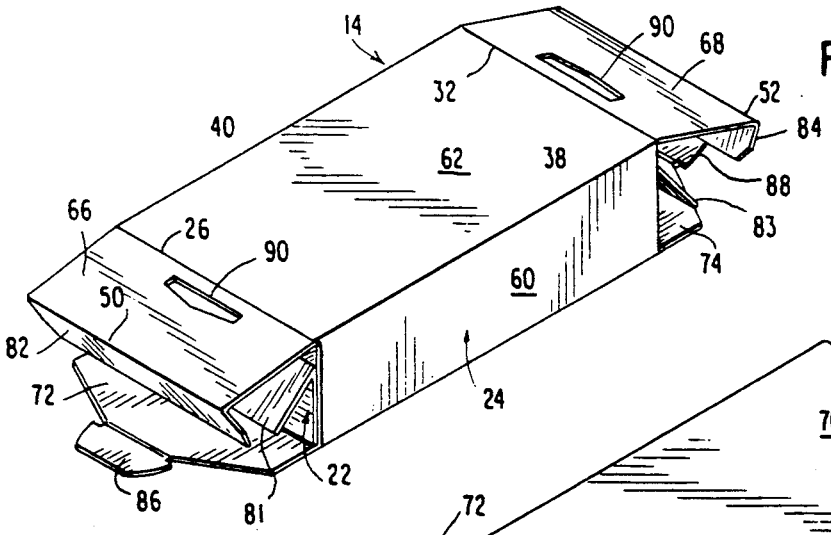
FIG. 5 is a further perspective view with the outer box section end wall flaps in position for adhesively joining the interior surface of the outer box section side wall to the exterior surface of the inner box section side wall to complete the double wall box closure.
Figure 6:
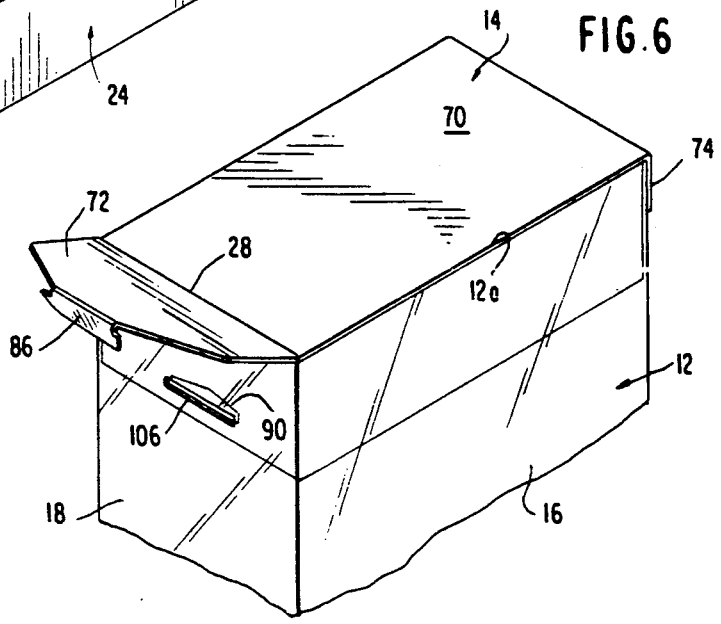
FIG. 6 is a perspective view of the completed double wall box closure inserted within an open end of the tubular sleeve and prior to tab insertion through aligned slots of the outer box section end walls and those of the tubular sleeve to complete the tab locked box closure coupling to an end of the tubular sleeve of the display package of FIG. 1.

Further, since the lugs 86 are wider at the inboard ends of the sloping side edges 94, proximate to the narrow bands 86*a*, 88*a*, the lugs are provided with the laterally opposed projections 98 which have their opposite ends, at a distance which is in excess of the length of the slots 90 receiving the same projections 98, defining barbs which impede accidental removal from slots 90 after engagement of the same, as described hereinafter in the sequence FIGS. 4–6 inclusive. Alternatively, instead of the lugs 86 having a plan configuration in the form of a quadrilateral trapezium, they may be of arrow head form, devoid of the flat edge 96. Further, the tapered edges 100 of base portions 72*a*, 74*a* of the tabs 72, 74 facilitate the creation of the fairly narrow locking lugs 86.

In the illustrated embodiment, interior surface portions 60*a* and 64*a* respectively of the outer box sections side walls 60 and 64 are coated with a pressure sensitive adhesive as at 102, 104 respectively. The purpose of the adhesive is to maintain the double wall box configuration of rectangular, parallelepiped form upon folding of the sections of the portions of the box blank 20 at the fold lines prior to completion of each display package by physically mounting and locking the insert closure boxes 14 within respective open ends of the tubular sleeve 10, FIG. 1. In achieving that function, the nature of the frictional locking of the insert box closure 14 to the tubular sleeve end is illustrated by the break away, in part of FIG. 1.

Turning next to FIG. 4, initiation of folding and forming of a two walled insert closure box 14 begins with the box blank 20 flat as per FIG. 3 at right angles in the same direction, the inner box section side wall 80 and end walls 84, 83. End walls 82, 84 are raised from horizontal to vertical position, as is side wall 80. Then, the inner box section 22 inner panel 78 is raised to a vertical upright position, at fold line 46, and subsequently the inner box side wall 76 is folded about fold line 44, causing the inner box section 22 inner panel 78 to move into a position overlaying the outer panel of the outer box section 24.

Under these conditions, the outer panel extensions or tabs 72, 74 extend outwardly of the formed but not secured inner box section 22 of the box insert closure 14. By folding the remainder of the insert box blank 20, along fold line 42, the outer box side wall 64 moves from a horizontal position to a vertical upright position. The pressure sensitive adhesive 104, on the inner surface thereof, is thus caused to press against and to seal against the outside surface of the inner box section side wall 80 thereby maintaining the balance of inner panel 62 and the outer box section side wall 60 vertically upright with the outer box end walls 82 and 84 extending away from the inner panel 78 at opposite ends.

It should be noted the pressure sensitive adhesive 104 occupies only the lower surface area 64*a* of the outer box section side wall inner surface. Further, the outer box section side wall 60 bear pressure sensitive adhesive 102 on the inner surface thereof adjacent its upper edge, and spaced some distance from the fold line 38. Since the width of the inner box section side walls 76 and 80 are much smaller than that of the outer box section side walls 60 and 64 in the next step, as per FIG. 5, folding the inner panel 62 of the outer box section 24 at right angles from vertical outer box section side wall 64, about fold line 40, and additionally folding outer box section side wall 60 at right angles to the outer box section inner panel 62, there is defined a rectangular cavity or space 65 between the vertically spaced inner box section inner panel 78 and the overlying outer box section inner panel 62. Further, in bringing the outer box section side wall 60 inner surface down over and in contact with the outer surface of the inner box side wall 76, the pressure sensitive adhesive 102 coated surface area 60*a* of that outer box side wall 60 adheres to the major surface portion of the inner section box side wall 76 to rigidly complete the formation of the double-walled insert closure box 14.

Simultaneously with or subsequent to the adhesive fixing of the inner surface of outer box section side wall against the exterior surface of the inner box section side wall 76, outer box section end walls 68 may be folded downwardly, about fold lines 26, 32, outer box section end walls 66, 68 may be folded respectively, downwardly at right angles about fold lines 46, 32 and, the outer box end wall flaps 82, 84 folded inwardly at right angles so as to underlay the free ends of the inner box section end walls 82, 84, respectively. Under such conditions, the narrow elongated slots 90 of end walls 66, 68 are aligned and face each other at opposites ends of the rectangular parallelepiped space 85 between outer box section inner panel 62 and inner box section inner panel 79.

Preferably, slots 90 are not of equal height over their length. One of oppositely facing long side surfaces, forming those elongated slots, is of a shallow v-shape providing a deflection area for the planar lugs 86, 88 so that they may be given a slight, momentary, arcuate flexing to permit the opposite edges of the barbs 98 to ride over the ends of the slots 90, into the space 85. Interiorly of the outer box section end walls 66, 68 the lugs reform into flat planar form with the barbs 98 captured behind the outer box section end walls 66, 68. Such action, however, occurs only after the double wall insert box closure box 14 is completed and after, the parallelepiped double box structure is inserted within one end of the tubular sleeve 12.

Further, it is necessary that the vertical end walls 18 of the tubular sleeve 12 be provided with a narrow, elongated slots preferably slightly longer than the slots 90 within the outer box section end walls 66, 68 and at corresponding locations vertically within the tubular sleeve end walls 18 to the insert box closure 14 so that the outer panel of the outer box section 24 lays flush with the outer edge of the tubular sleeve 14. Under such conditions, prior to bending extensions or tabs 72, 74, they extend outwardly of and across the respective edges of the end walls 18 of the tubular sleeve, equal to the width of those end walls 18. The tabs are then folded along fold lines 34, at right angles such that the tabs extend downwardly in surface contact with respective exterior surfaces of the tubular sleeve end walls 18. Further, the lugs 86 and 88 of tabs 72, 74 are respectively bent inwardly at right angles towards the confronting slots 106 within the ends of the tubular sleeve side walls 18, through which the lugs pass, and through the aligned slots 90 of outer box section end walls 66, 68, respectively.

As a result, particularly when the lugs pass through the shorter length slots 90 within the outer box section end walls 66, 68, the barbs 98 snap back to frictionally lock the insert closure boxes 14 at opposite ends of the tubular sleeve 18 forming an attractive and functional see-through package. Further, the rectangular, parallelepiped double-walled insert closure boxes 14 are of sufficient strength to support objects within the package or container of several pounds without flexing, distortion or compression of the cardboard double-walled box structures. Therefore, the insert closure boxes function as a support, particularly for articles which are generally of a length equal to a distance between the insert closure boxes 14 once inserted and coupled to the tubular sleeve to form a completed package 10.

It should be noted, that to facilitate assembly and insertion of the end wall flaps 82, 84 into the narrow space between the lower edge of the outer box end walls 66, 68, the lateral tips of the end wall flaps 82, 84 may be beveled as at 100. It should be apparent from the above description and by viewing the drawing figures, that the inner box section 22 is both longitudinally and laterally dimensional, corresponding to the cross-section of the outer box section 24, within which the inner box section 22 resides but not, in the illustrated embodiment, dimensionally corresponding to the vertical cross-section due to the height differential between the inner box section 22 and that of the outer box section 24. Further, the rectangular, parallelepiped outer box section 24 is rectangularly dimensional corresponding to the cross-section of the sleeve within which it resides upon insertion and locking. This requires therefore close dimensional control of all of the various panels, side walls, end walls, etc. of the blanks 20 to complete the inner box/outer box double wall reinforced hollow box structures to form a completed display package 10.

As may be appreciated from the above description, and from the drawings, the present invention provides a simple and effective construction which provides a very stable, rigid and visually pleasing package. Various modifications of detail, advised by circumstances and practice may be introduced to the example described above are embodied by the present invention as long as those variations introduced do not change, alter or modify the essence of the embodiment described.

Although the present invention has been described in connection with a preferred embodiment thereof, many other variations and modifications may be apparent to those skilled in the art. It is preferred therefore that the present invention be limited not by the specific disclosure herein, but only by the appendant claims.

What is claimed is:

1. A tubular display package comprising:

an open-ended flexible sheet material sleeve of rectangular cross-section including laterally opposed side walls and longitudinally opposed end walls, at least one outer folded sheet material, hollow insert closure box of rectangular, parallelepiped form defining an outer box section including; spared inner and outer panels of rectangular plan form, laterally opposed side walls and longitudinally opposed end walls, said closed, hollow box inserted within an open end of said sleeve, tabs integral with said insert closure box outer panel and extending longitudinally beyond the outer box section end walls, at opposite ends thereof, and those of said sleeve and overlying the same, and being of a width corresponding to that of the outer box section end walls, said two end walls of said tubular sleeve and said box insert end walls each having a narrow slot therein, proximate to an open end of said tabular sleeve and extending parallel to the outer and inner, panels of said insert closure box, and each of said tabs terminating at an end remote from said insert closure box outer wall in a lug of a width generally equal to the length of said slots, the slots of corresponding box insert end walls and tubular sleeve end walls being aligned each said tab being bent at right angles to the outer box section outer panel, extending parallel to and in contact with the outside surface of the tubular sleeve end wall and said lug being bent at right angles inwardly of said tubular sleeve end wall and passing through said aligned slots and being in frictional engagement at least with said outer box section inner panel end wall bearing said slot, upon passage therethrough.

2. The tubular display package as claimed in claim 1, wherein said at least one outer insert closure box comprises a double-walled folded sheet material, rectangular, parallelepiped hollow box structure and further including an inner box section, said inner box section having at least a reinforcing inner panel overlaying the outer box section outer panel and being spaced therefrom, laterally opposed side walls and longitudinally opposed end walls integral with said reinforcing inner panel and extending respectively at right angles thereto, and wherein, at least said inner box section side walls are sized to and configured to dimensionally 14 correspond to the cross-section of the outer box section and extend parallel to and against outer box section side walls and end walls respectively, thereby forming said double-walled structure.

3. The tubular display package as claimed in claim 2, wherein said inner box section side walls are adhesively affixed to the outer box section side walls.

4. The tubular display package as claimed in claim 1, wherein the elongated slots of said outer box section end walls are of a shorter length then the slots within a tubular sleeve end walls aligned therewith but slightly less than the width of said lugs inserted therethrough.

5. The tubular display package as claimed in claim 2, wherein the elongated slots of said inner box section end walls are of a shorter length then the slots within a tubular sleeve end wall aligned therewith but slightly less than the width of said lugs inserted therethrough.

6. The tubular display package as claimed in claim 3, wherein the elongated slots of said inner box section end walls are of a shorter length then the slots within a tubular sleeve end wall aligned therewith but slightly less than the width of said lugs inserted therethrough.

7. The tubular display package as claimed in claim 1, wherein each said lug has the shape of a quadrilateral-trapezium integrally joined to a base portion of the tab by a narrow band of a width less than the length of the elongated slots through which the lug passes and said lug includes projections extending outwardly in opposite directions from the narrow band, proximate to said narrow band, and wherein the distance between the outer edges of the projections is in excess of the length of the narrow slot within the outer box section end wall through which the lug extends, and wherein said slots within the outer box section end walls have opposing long edges with at least one long edge being of shallow v-shaped configuration facing the opposite long edge thereof permitting the lug to flex in said narrow slot and to pass said projections therethrough for facilitating frictional coupling between said lug and said outer box section end wall after passage through said aligned slots.

8. The tubular display package as claimed in claim 4, wherein each said lug has the shape of a quadrilateral-trapezium integrally joined to a base portion of the tab by a narrow band of a width less than the length of the elongated slots through which the lug passes and said lug includes projections extending outwardly in opposite directions from the narrow band, proximate to said narrow band, and wherein the distance between the outer edges of the projections is in excess of the length of the narrow slot within the outer box section end wall through which the lug extends, and wherein said slots within the outer box section end walls have opposing long edges with at least one long edge being of shallow v-shaped configuration facing the opposite long edge thereof permitting the lug to flex in said narrow slot to pass said projections therethrough for facilitating frictional coupling between the lug and said outer box section end wall after passage through said aligned slots.

9. The tubular display package as claimed in claim 5, wherein each said lug has the shape of a quadrilateral-trapezium integrally joined to a base portion of the tab by a narrow band of a width less than the length of the elongated slots through which the lug passes and said lug includes projections extending outwardly in opposite directions from the narrow band, proximate to said narrow band, and wherein the distance between the outer edges of the projections is in excess of the length of the narrow slot within the outer box section end wall through which the lug extends, and wherein said slots within the outer box section end walls have opposing long edges with at least one long edge being of shallow v-shaped configuration facing the opposite long edge thereof permitting the lug to flex in said narrow slot to pass said projections therethrough for facilitating frictional coupling between the lug and said outer box section end walls after passage through said aligned slots.

10. The tubular display package as claimed in claim 1, wherein said projections form a barb 6, having oppositely oblique edges directed towards each other in a direction away from the tab base to facilitate inserting of the lug into said aligned slots and to prevent decoupling of the insert closure boxes from the ends of the tubular sleeve after frictional coupling is effected.

11. The tubular display package as claimed in claim 2, wherein the inner box section and the outer box sections of the insert closure box are of dimensions, said aligned slots within the outer box section end wall and the ends of the tubular sleeve are so located and, the length of the flaps including the tabs and the positioning of the same, are such that the lugs occupy positions in the space between the inner box reinforcing panel and the inner box section and the inner panel of the outer box section upon completion of coupling of the insert closure box to an end of the tubular sleeve.

12. The tubular display package as claimed in claim 1, wherein the inner box section and the outer box sections of the insert closure box are of dimensions, said aligned slots within the outer box section end wall and the ends of the tubular sleeve are so located and, the length of the flaps including the tabs and the positioning of the same, are such that the lugs occupy positions in the space between the inner box reinforcing panel of the inner box section and the inner panel of the outer box section upon completion of coupling of the insert closure box to an end of the tubular sleeve.

* * * * *